US006015357A

United States Patent [19]

Rizza

[11] Patent Number: 6,015,357

[45] Date of Patent: Jan. 18, 2000

[54] BROADHEAD FOR USE AS BOTH AN EXPANDABLE BLADE HEAD AND A FIXED BLADE HEAD

[76] Inventor: Joseph D. Rizza, 135 W. Franklin St., Bound Brook, N.J. 08805

[21] Appl. No.: 09/203,889

[22] Filed: Dec. 2, 1998

[51] Int. Cl.[7] ..... F42B 6/08

[52] U.S. Cl. ..... 473/583

[58] Field of Search ..... 473/583, 584, 473/FOR 221, FOR 222

[56] References Cited

U.S. PATENT DOCUMENTS

| | | | |
|---|---|---|---|
| 2,568,417 | 9/1951 | Steinbacher | 473/583 |
| 4,452,460 | 6/1984 | Adams | 473/584 |
| 4,973,060 | 11/1990 | Herzing . | |
| 5,046,744 | 9/1991 | Eddy | 473/583 |
| 5,066,021 | 11/1991 | DeLucia | 473/583 |
| 5,078,407 | 1/1992 | Carlston et al. . | |
| 5,083,798 | 1/1992 | Massey . | |
| 5,090,709 | 2/1992 | Johnson . | |
| 5,100,143 | 3/1992 | Puckett | 473/583 |
| 5,322,297 | 6/1994 | Smith . | |
| 5,458,341 | 10/1995 | Forrest et al. | 473/583 |
| 5,564,713 | 10/1996 | Mizek et al. . | |
| 5,820,498 | 10/1998 | Maleski | 473/584 |

*Primary Examiner*—John A. Ricci
*Attorney, Agent, or Firm*—Richard L. Miller, P.E.

[57] ABSTRACT

A broadhead for use as both an expandable blade head and a fixed blade head. The broadhead includes a shaft, a blade assembly, and locking apparatus. The locking apparatus operatively connected to the blade assembly comprises a disk having three slots, which when desired, can be rotatively aligned so as to prevent the distal ends of the bodies the blade assembly from leaving the slots thereby selectively maintaining the blade assembly in a retracted mode. The blade assembly has an elastic ring which extends around the hypothenuse of each blade and in one annular groove in the body of the blade assembly when the blade assembly is in the retracted mode, with the tension of the elastic ring and the one annular groove chosen determining amount of force necessary for the blade assembly to achieve the expanded position, and with the blade assembly achieving the expanded position after the blade assembly has entered a prey and the barb on each blade contacts hard tissue causing the three blades to pivot outwardly and backwardly until the base of each blade seats in the associated slot in the body of the blade assembly and the elastic ring jumps out of the one annular groove and becomes lodged around the base of each blade, between the projection thereon and the hypothenuse thereof, causing the blade assembly to be maintained in the expanded position.

27 Claims, 2 Drawing Sheets

BROADHEAD FOR USE AS BOTH AN EXPANDABLE BLADE HEAD AND A FIXED BLADE HEAD

BACKGROUND OF THE INVENTION

1. Field of the Invention

The present invention relates to a broadhead. More particularly, the present invention relates to a broadhead for use as both an expandable blade head and a fixed blade head.

2. Description of the Prior Art

Numerous innovations for expandable broadheads have been provided in the prior art that will be described. Even though these innovations may be suitable for the specific individual purposes to which they address, however, they differ from the present invention.

A FIRST EXAMPLE, U.S. Pat. No. 4,973,060 to Herzing teaches an expandable broadhead for a hunting arrow that includes a first elongate member having a rear end adapted to be releasably attached to the front end of an arrow shaft and a longitudinally extending forward portion. There is a second elongate member that has a tipped front end and a rearwardly extending portion adapted to slidably connect with the longitudinally extending forward portion of the first member, and for guiding the second member in axial movement relative to the first member from a forward position to a rearward position. Each of a pair of blades with sharpened outer edges has a front end that is pivotally connected to the second elongate member. There is a pair of linking arms, each arm having a rear end that is pivotally connected to the first elongate member and a forward end that pivotally connects with a blade at a point therealong spaced from the front end of the blade. The arrowhead has a first configuration in which the blades are retracted in a low-profile aerodynamic configuration, and in which the second elongate member is in its forward position. When the tipped portion of the second elongate member makes impact with a target, the aforedescribed construction will allow force of impact to move the second elongate member towards the first elongate member and to urge outwardly the connection point of each linking arm and blade to move the blades to an extended, divergent configuration.

A SECOND EXAMPLE, U.S. Pat. No. 5,078,407 to Carlston et al. teaches a multi-bladed expandable broadhead, composite fiber, plastic hunting arrow tip. The tip is comprised of a high strength, light weight fibrous composite plastic material. It incorporates the use of rotatable blades which are trunion mounted securely in the body of the tip, and which are designed to be partially exposed while in flight. The blades are configured such that they will rotate into an expanded position upon impact. The blades are mounted in a forward position with the tips of the blades protruding outside of the tip body.

A THIRD EXAMPLE, U.S. Pat. No. 5,083,798 to Massey teaches a broadhead that has an elongate body with an axial cavity and a plurality of longitudinal slots are spaced radially through the wall of the body and a blade is disposed in each of the longitudinal slots. Each of the blades is pivotally mounted at the end nearest the tip so that they may selectively pivot through the slot from a retracted position or an extended position. Each blade has a cam edge which fits within the slot associated with the blade when the blade is pivoted into the retracted position. A slug is adapted to slide within the longitudinal cavity of the body and engage the cams of the blades when the blades are in the retracted positions and cause the blades to project outwardly as the slug moves forward within the cavity from a starting position adjacent to the shaft end of the body. A hook is also provided on each of the blades and a catch engages the hooks on the blades and retains them in the retracted position when the slug is positioned adjacent to the shaft end of the cavity. In the preferred embodiment, the slug is magnetized and a second magnet polarized to attract the slug is positioned at the end of the cavity adjacent the arrow shaft. The blades are made of a magnetic material such as steel and the body is made of a nonmetallic material such as aluminum.

A FOURTH EXAMPLE, U.S. Pat. No. 5,090,709 to Johnson teaches an arrow that has an arrowhead with fixed cutting blades and extendable blades located adjacent the fixed blades. The blades are mounted on a tubular body having longitudinal slots accommodating the blades. A nose attached to the forward end of the body retains the fixed blades on the body. Pins pivotally connect the extendable blades on the body. A ring releasably holds the extendable blades in the slots.

A FIFTH EXAMPLE, U.S. Pat. No. 5,322,297 to Smith teaches a broadhead for connecting to the end of an arrow that comprises a shaft having a longitudinal cylindrical shaped body and a plurality of blades pivotally attached to a blade holder that is slidably mounted upon the shaft. The blades are resiliently held in a retracted position during flight by at least one O-ring. When the broadhead impacts against an animal, the blade holder is slidably forced rearward allowing the blades to pivot outward into an extended position.

A SIXTH EXAMPLE, U.S. Pat. No. 5,564,713 to Mizek et al. teaches a blade-opening arrowhead wherein at least one blade, preferably two blades, are pivotally mounted with respect to a blade carrying body. A bias force is used to urge an engagement member against a corresponding blade. The bias force is preferably selected so that each blade remains in a normally closed position during flight or during handling of the arrowhead, but yet responsively and quickly moves to a fully open position upon impact or when a sufficient opening force is applied to the blade.

It is apparent that numerous innovations for expandable broadheads have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a broadhead for use as both an expandable blade head and a fixed blade head that avoids the disadvantages of the prior art.

ANOTHER OBJECT of the present invention is to provide a broadhead for use as both an expandable blade head and a fixed blade head that is simple and inexpensive to manufacture.

STILL ANOTHER OBJECT of the present invention is to provide a broadhead for use as both an expandable blade head and a fixed blade head that is simple to use.

BRIEFLY STATED, YET ANOTHER OBJECT of the present invention is to provide a broadhead for use as both an expandable blade head and a fixed blade head. The broadhead includes a shaft, a blade assembly, and locking apparatus. The blade assembly has an elastic ring which extends around the hypothenuse of each blade and in one annular groove in the body of the blade assembly when the blade assembly is in the retracted mode, with the tension of the elastic ring and the one annular groove chosen determining amount of force necessary for the blade assembly to achieve the expanded position, and with the blade assembly achieving the expanded position after the blade assembly has entered a prey and the barb on each blade contacts hard tissue causing the three blades to pivot outwardly and backwardly until the base of each blade seats in the associated slot in the body of the blade assembly and the elastic ring jumps out of the one annular groove and becomes lodged around the base of each blade, between the projection thereon and the hypothenuse thereof, causing the blade assembly to be maintained in the expanded position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figures 1, 1A, 2, 5:
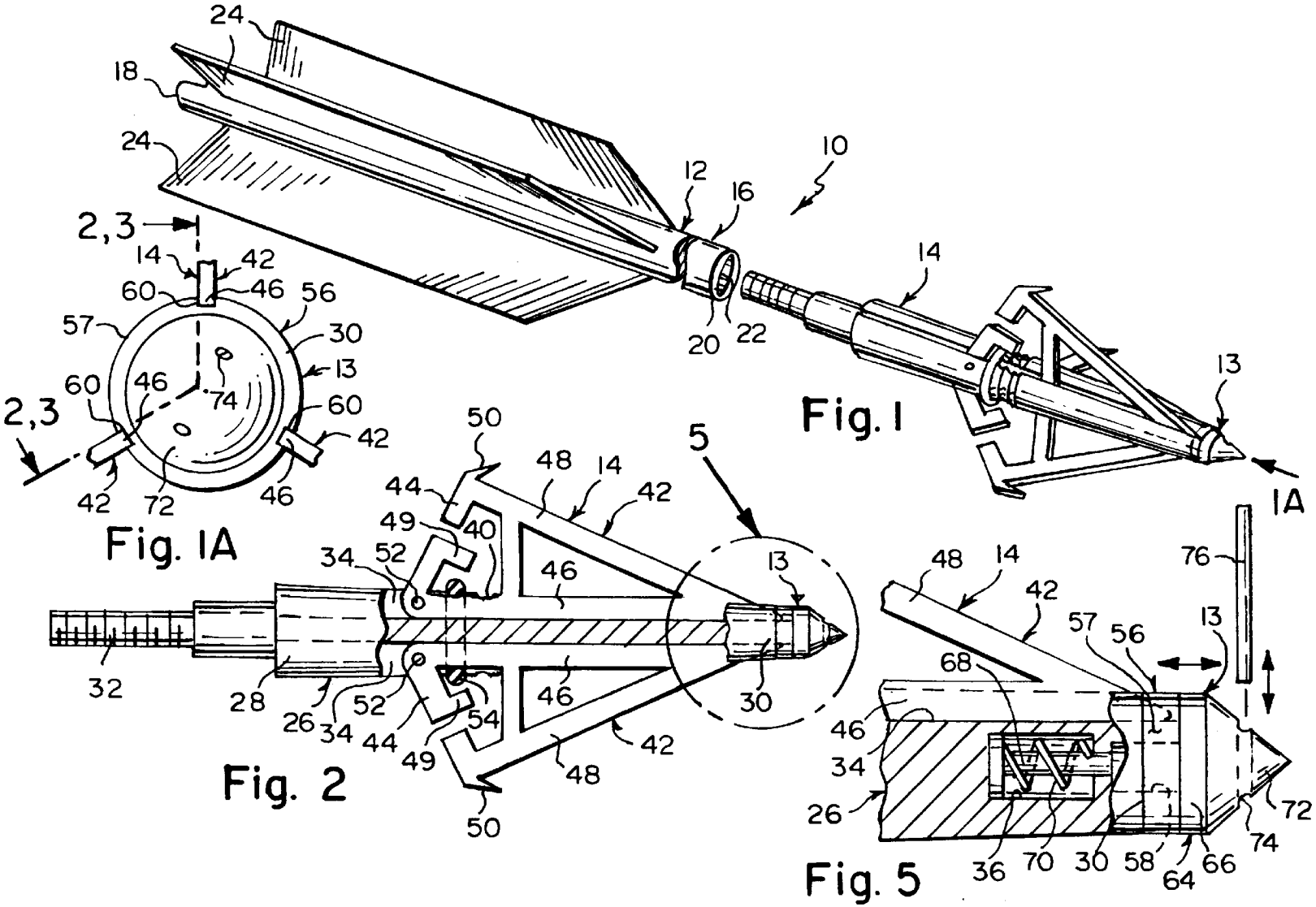
FIG. 1 is a diagrammatic perspective view of the present invention with the expandable and retractable blade assembly thereof in the retracted mode.
FIG. 1A is a diagrammatic front elevational view taken generally in the direction of arrow 1A in FIG. 1.
FIG. 2 is a diagrammatic cross sectional view taken on line 2—2 in FIG. 1A of the expandable and retractable blade assembly of the present invention in the retracted mode.
FIG. 5 is an enlarged diagrammatic cross sectional view of the area generally enclosed by the dotted circle identified by arrow 5 in FIG. 2 of another embodiment of the blade lock assembly of the present invention.

10 broadhead for use as both an expandable blade head and a fixed blade head of the present invention
12 shaft
13 locking apparatus
14 blade assembly
16 shank of shaft 12
18 proximal end of shank 16 of shaft 12 for releasably engaging string of bow
20 distal end of shank 16 of shaft 12
22 bore in distal end 20 of shank 16 of shaft 12
24 three sets of feathers on shaft 12
26 body of blade assembly 14
28 proximal end of body 26 of blade assembly 14
30 distal end of body 26 of blade assembly 14
32 rod on proximal end 28 of body 26 of blade assembly 14
34 three slots in body 26 of blade assembly 14
36 bore in distal end 30 of body 26 of blade assembly 14
38 tab on distal end 30 of body 26 of blade assembly 14
40 plurality of annular grooves in body 26 of blade assembly 14
42 three blades of blade assembly 14
44 base of each blade of three blades 42 of blade assembly 14
46 hypothenuse of each blade of three blades 42 of blade assembly 14
48 leg of each blade of three blades 42 of blade assembly 14
49 projection on base 44 of each blade of three blades 42 of blade assembly 14
50 barb on each blade of three blades 42 of blade assembly 14
52 pivot pin of each blade of three blades 42 of blade assembly 14
54 elastic ring of blade assembly 14
56 disk of locking apparatus 13
57 perimeter of disk 56 of locking apparatus 13
58 throughbore extending coaxially through disk 56 of locking apparatus 13
60 three slots in disk 56 of locking apparatus 13
62 three throughbores in disk 56 of locking apparatus 13
64 ferrule assembly of locking apparatus 13
66 collar of ferrule assembly 64 of locking apparatus 13
68 post of ferrule assembly 64 of locking apparatus 13
70 compression spring of ferrule assembly 64 of locking apparatus 13
72 point of locking apparatus 13
74 throughbore extending transversely through point 72 of locking apparatus 13
76 rod of locking apparatus 13

Alternate Embodiment of Locking Apparatus 13

113 locking apparatus
114 blade assembly
126 body of blade assembly 114
130 distal end of body 126 of blade assembly 114
136 threaded bore in distal end 130 of body 126 of blade assembly 114
168 threaded post

Alternate Embodiment of Disk 56 of Locking Apparatus 13, 113

156 disk of locking apparatus 13, 113
160 three slots in disk 156 of locking apparatus 13, 113
162 three throughbores in disk 156 of locking apparatus 13, 113

DETAILED DESCRIPTION OF THE PREFERRED EMBODIMENT

Referring now to the figures in which like numerals indicate like parts, and particularly to FIG. 1, the broadhead for use as both an expandable blade head and a fixed blade head of the present invention is shown generally at 10.

The general configuration of the broadhead for use as both an expandable blade head and a fixed blade head 10 can best be seen in FIG. 1, and as such, will be discussed with reference thereto.

The broadhead for use as both an expandable blade head and a fixed blade head 10 comprises a shaft 12, a blade assembly 14 having an expanded mode and a retracted mode, and being threadably mounted to the shaft 12, and locking apparatus 13 operatively connected to the blade assembly 14 and selectively maintaining the blade assembly 14 in the retracted mode.

The specific configuration of the shaft 12 can best be seen in FIG. 1, and as such, will be discussed with reference thereto.

The shaft 12 comprises a shank 16 that is elongated, slender and cylindrically-shaped, and has a proximal end 18 for releasably engaging a string (not shown) of a bow (not shown) and a distal end 20 with a bore 22 that is threaded and extends axially therein and threadably receives the blade assembly 14.

The shaft 12 further comprises three sets of feathers 24 that are equally-spaced around, and extend radially outwardly from, the shank 16 of the shaft 12, in close proximity to the proximal end 18 of the shank 16 of the shaft 12.

The specific configuration of the blade assembly 14 can best be seen in FIGS. 1–4, and as such, will be discussed with reference thereto.

The blade assembly 14 comprises a body 26 that is elongated, slender, and substantially cylindrically-shaped, and has a proximal end 28 that engages the distal end 20 of the shank 16 of the shaft 12 and tapers axially forwardly therefrom to a distal end 30.

The proximal end 28 of the body 26 of the blade assembly 14 has a rod 32 that is threaded and extends coaxially outwardly therefrom and threadably engages in the bore 22 in the distal end 20 of the shank 16 of the shaft 12.

The body 26 of the blade assembly 14 further has three slots 34 that are equally spaced-apart, radially-oriented and extend axially from the proximal end 28 of the body 26 of the blade assembly 14 to and opens into, the distal end 30 of the body 26 of the blade assembly 14.

The distal end 30 of the body 26 of the blade assembly 14 has a bore 36 that extends axially therein, and a tab 38 that extends axially forwardly therefrom, offset from the bore 36 in the distal end 30 of the body 26 of the blade assembly 14, between a pair of slots of the three slots 34 in the body 26 of the blade assembly 14.

The body 26 of the blade assembly 14 further has a plurality of annular grooves 40 that extend circumferential and laterally therearound, are spaced apart, and disposed intermediate the proximal end 28 of the blade assembly 14 and the distal end 30 of the blade assembly 14.

The blade assembly 14 further comprises three blades 42.

Each blade of the three blades 42 of the blade assembly 14 is pivotally mounted in an associated slot of the three slots 34 in the body 26 of the blade assembly 14.

Each blade of the three blades 42 of the blade assembly 14 is right-triangular-shaped and has a base 44 that extends radially outwardly forwardly from the associated slot of the three slots 34 in the body 26 of the blade assembly 14 when the blade assembly 14 is in the retracted mode and contacts the associated slot of the three slots 34 in the body 26 of the blade assembly 14 when the blade assembly 14 is in the extended mode.

Each blade of the three blades 42 of the blade assembly 14 further has a hypothenuse 46 that is sharp and extends axially in the associated slot of the three slots 34 in the body 26 of the blade assembly 14 when the blade assembly 14 is in the retracted mode and extends radially outwardly rearwardly when the blade assembly 14 is in the extended mode.

Each blade of the three blades 42 of the blade assembly 14 further has a leg 48 that is sharp and connects the base 44 thereof to the hypothenuse 42 thereof and is free of the associated slot of the three slots 34 in the body 26 of the blade assembly 14 when the blade assembly 14 is in the retracted mode and extends radially outwardly when the blade assembly 14 is in the extended mode.

The base 44 of each blade of the three blades 42 of the blade assembly 14 has a projection 49 that extends perpendicularly upwardly theref rom, intermediate the leg 48 thereof and the hypothenuse 46 thereof.

Each blade of the three blades 42 of the blade assembly 14 further has a barb 50 that extends outwardly from where the base 44 thereof meets the leg 48 thereof, and faces forwardly when the blade assembly 14 is in the retracted mode and is in the associated slot of the three slots 34 in the body 26 of the blade assembly 14 when the blade assembly 14 is in the extended mode.

Each blade of the three blades 42 of the blade assembly 14 is pivotally mounted in an associated slot of the three slots 34 in the body 26 of the blade assembly 14 by a pivot pin 52 that passes through where the base 44 thereof meets the hypothenuse 46 thereof.

The blade assembly 14 further comprises an elastic ring 54 with a tension and which extends around the hypothenuse 46 of each blade of the three blades 42 of the blade assembly 14 and in one annular groove of the plurality of annular grooves 40 in the body 26 of the blade assembly 14 when the blade assembly 14 is in the retracted mode, with the tension of the elastic ring 54 and the one annular groove of the plurality of annular grooves 40 in the body 26 of the blade assembly 14 chosen determining amount of force necessary for the blade assembly 14 to achieve the expanded position, and with the blade assembly 14 achieving the expanded position after the blade assembly 14 has entered a prey (not shown) and the barb 50 of each blade of the three blades 42 of the blade assembly 14 contacts hard tissue causing the three blades 42 of the blade assembly 14 to pivot outwardly and backwardly until the base 44 of each blade of the three blades 42 of the blade assembly 14 seats in the associated slot of the three slots 34 in the body 26 of the blade assembly 14 and the elastic ring 54 of the blade assembly 14 jumps out of the one annular groove of the plurality of annular grooves 40 in the blade assembly 14 and becomes lodged around the base 44 of each blade of the three blades 42 of the blade assembly 14, between the projection 49 thereof and the hypothenuse 46 thereof, causing the blade assembly 14 to be maintained in the expanded position.

Figure 6:
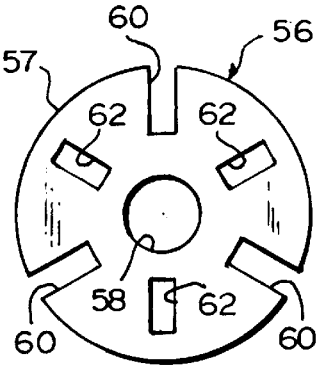
FIG. 6 is an enlarged cross sectional view taken on line 6—6 in FIG. 3 of one embodiment of the lock disk of the blade lock assembly of the present invention.

The specific configuration of the locking apparatus 13 can best be seen in FIGS. 5 and 6, and as such, will be discussed with reference thereto.

The locking apparatus 13 comprises a disk 56 that is coaxially and rotatably disposed on, and has same diameter as, the distal end 30 of the body 26 of the blade assembly 14.

The disk 56 of the locking apparatus 13 has a perimeter 57 and a throughbore 58 that extends coaxially therethrough and communicates with the bore 36 in the distal end 30 of the body 26 of the blade assembly 14.

The disk 56 of the locking apparatus 13 further has three slots 60 that extend radially inwardly from, and open into, the perimeter 57 of the disk 56 of the locking apparatus 13, and selectively align, by rotation of the disk 56 of the locking apparatus 13, respectively, with the three slots 34 in the body 26 of the blade assembly 14 when the blade assembly 14 is in the retracted mode and the blade assembly wishes to ultimately achieve the expanded mode, by allowing the three blades 42 of the blade assembly 14 to leave the three slots 60 in the disk 56 of the locking apparatus 13.

The disk 56 of the locking apparatus 13 further has three throughbores 62 that extend radially in the disk 56 of the locking apparatus 13, between the three slots 60 in the disk 56 of the locking apparatus 13, and do not open into the perimeter 57 of the disk 56 of the locking apparatus 13 and the throughbore 58 in the disk 56 of the locking apparatus 13.

The three throughbores 62 in the disk 56 of the locking apparatus 13 selectively align, by rotation of the disk 56 of the locking apparatus 13, respectively, with the three slots 34 in the body 26 of the blade assembly 14 when the blade assembly 14 is in the retracted mode and it is not wished that the blade assembly 14 ultimately achieve the expanded mode, by capturing and preventing the three blades 42 of the blade assembly 14 from leaving the three slots 60 in the disk 56 of the locking apparatus 13.

The disk 56 of the locking apparatus 13 is prevented from further rotation once aligned, by the tab 38 on the distal end 30 of the body 26 of the blade assembly 14 engaging one of one slot of the three slots 60 in the disk 56 of the locking apparatus 13 and one throughbore of the three throughbores 62 in the disk 56 of the locking apparatus 13.

The locking apparatus 13 further comprises a ferrule assembly 64 that comprises a collar 66 that is coaxially and axially movably disposed on, and has same diameter as, the disk 56 of the locking apparatus 13.

The ferrule assembly 64 of the locking apparatus 13 further comprises a post 68 that extends coaxially from the collar 66 of the ferrule assembly 64 of the locking apparatus 13, freely through the throughbore 58 in the disk 56 of the locking apparatus 13, and axially movably into the bore 36 in the distal end 30 of the body 26 of the blade assembly 14.

The ferrule assembly 64 of the locking apparatus 13 further comprises a compression spring 70 that is disposed around the post 68 of the ferrule assembly 64 of the locking apparatus 13, and biases the collar 66 of the ferrule assembly 64 of the locking apparatus 13 against the disk 56 of the locking apparatus 13 which causes the disk 56 of the locking apparatus 13 to be biased against the distal end 30 of the body 26 of the blade assembly 14, which prevents unintentional rotation of the disk 56 of the locking apparatus 13.

The locking apparatus 13 further comprises a point 72 which is disposed on the collar 66 of the ferrule assembly 64 of the locking apparatus 13 for movement therewith.

The point 72 of the locking apparatus 13 has a throughbore 74 that extends transversely therethrough, which removably receives a rod 76 that when pulled, causes the collar 66 of the ferrule assembly 64 of the locking apparatus 13 to move axially outwardly away from the disk 56 of the locking apparatus 13, against the biasing of the spring 70 of the ferrule assembly 64 of the locking apparatus 13, allowing the disk 56 of the locking apparatus 13 to be intentionally rotated.

Figure 3:
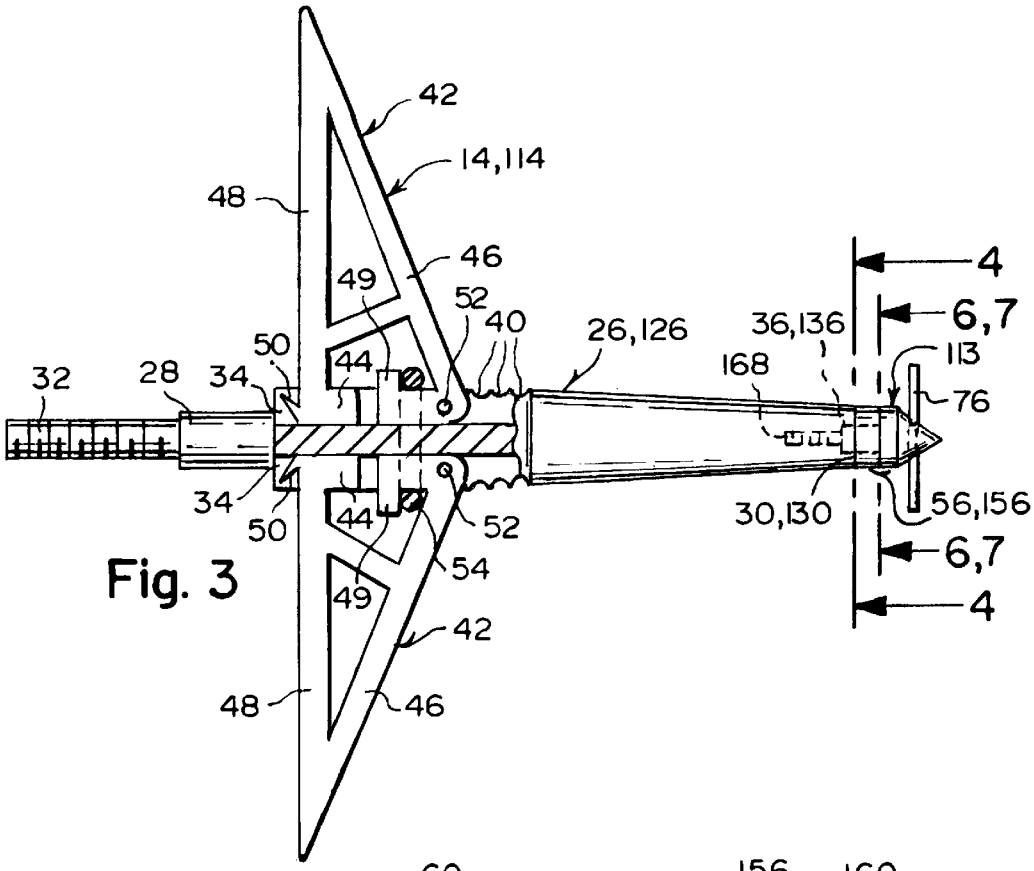
FIG. 3 is a diagrammatic cross sectional view taken on line 3—3 in FIG. 1A of the expandable and retractable blade assembly of the present invention in the exp anded mode, with one embodiment of the blade lock assembly of the present invention.
Figure 4:
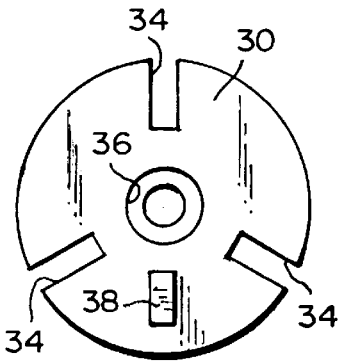
FIG. 4 is an enlarged cross sectional view taken on line 4—4 in FIG. 3.

An alternate embodiment locking apparatus 113 can best be seen in FIG. 3, and as such, will be discussed with reference thereto.

The locking apparatus 113 is similar to the locking apparatus 13, except:

1) The spring 70 of the locking apparatus 13 is eliminated.
2) The bore 36 in the distal end 30 of the body 26 of the blade assembly 14 is a threaded bore 136.
3) The post 68 of the ferrule assembly 64 of the locking apparatus 13 is a threaded post 168 that threadably moves in the threaded bore 136 in the distal end 130 of the body 126 of the blade assembly 114 when the rod 176 of the locking apparatus 113 is rotated.

Figure 7:
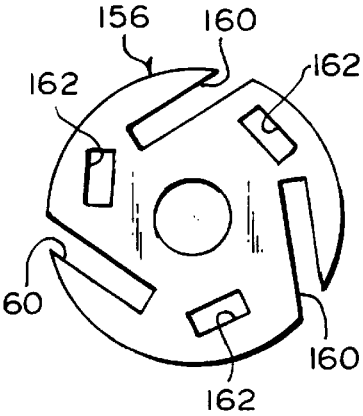
FIG. 7 is an enlarged cross sectional view taken on line 7—7 in FIG. 3 of another embodiment of the lock disk of the blade lock assembly of the present invention.

An alternate embodiment disk 156 of the locking apparatus 13, 113 can best be seen in FIG. 7, and as such, will be discussed with reference thereto.

The disk 156 of the locking apparatus 13, 113 is similar to the disk 56 of the locking apparatus 13, 113, except:

1) The three slots 160 in the disk 156 of the locking apparatus 13, 113 do not extend radially, but rather extend skewly.
2) The three throughbores 162 in the disk 156 of the locking apparatus 13, 113 do not extend radially, but rather extend circularly.

Base 44 is noncontinuous adjacent the projection 49 so as to allow insertion of the elastic ring 54 there through during initial fabrication or any time subsequent there after.

It will be understood that each of the elements described above, or two or more together, may also find a useful application in other types of constructions differing from the types described above.

While the invention has been illustrated and described as embodied in a broadhead for use as both an expandable blade head and a fixed blade head, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A broadhead for use as both an expandable blade head and a fixed blade head, said broadhead comprising:

a) a shaft;

b) a blade assembly having an expanded mode and a retracted mode, and being threadably mounted to said shaft; and c) locking apparatus operatively connected to said blade assembly and selectively maintaining said blade assembly in said retracted mode, wherein said shaft comprises a shank that is elongated, slender and cylindrically-shaped, and has:

i) a proximal end for releasably engaging a string of a bow; and ii) a distal end with a bore that is threaded and extends axially therein and threadably receives said blade assembly, wherein said blade assembly comprises a body that is elongated, slender, and substantially cylindrically-shaped, and has a proximal end that engages said distal end of said shank of said shaft and tapers axially forwardly therefrom to a distal end, wherein said body of said blade assembly further has three slots that are equally spaced-apart, radially-oriented and extend axially from said proximal end of said body of said blade assembly, to, and opens into, said distal end of said body of said blade assembly, wherein said distal end of said body of said blade assembly has:

A) a bore that extends axially therein; and

B) a tab that extends axially forwardly therefrom, offset from said bore in said distal end of said body of said blade assembly, between a pair of slots of said three slots in said body of said blade assembly.

2. The broadhead as defined in claim 1, wherein said shaft further comprises three sets of feathers that are equally-spaced around, and extend radially outwardly from, said shank of said shaft, in close proximity to said proximal end of said shank of said shaft.

3. The broadhead as defined in claim 1, wherein said proximal end of said body of said blade assembly has a rod that is threaded and extends coaxially outwardly therefrom and threadably engages in said bore in said distal end of said shank of said shaft.

4. The broadhead as defined in claim 1, wherein said body of said blade assembly further has a plurality of annular grooves that extend circumferential and laterally therearound, are spaced apart, and disposed intermediate said proximal end of said blade assembly and said distal end of said blade assembly.

5. The broadhead as defined in claim 4, wherein said blade assembly further comprises three blades.

6. The broadhead as defined in claim 5, wherein each blade of said three blades of said blade assembly is pivotally mounted in an associated slot of said three slots in said body of said blade assembly.

7. The broadhead as defined in claim 5, wherein each blade of said three blades of said blade assembly is right-triangular-shaped and has a base that extends radially outwardly forwardly from an associated slot of said three slots in said body of said blade assembly when said blade assembly is in said retracted mode and contacts said associated slot of said three slots in said body of said blade assembly when said blade assembly is in said extended mode.

8. The broadhead as defined in claim 7, wherein each blade of said three blades of said blade assembly further has a hypothenuse that is sharp and extends axially in said associated slot of said three slots in said body of said blade assembly when said blade assembly is in said retracted mode and extends radially outwardly rearwardly when said blade assembly is in said extended mode.

9. The broadhead as defined in claims 8, wherein each blade of said three blades of said blade assembly further has a leg that is sharp and connects said base thereof to said hypothenuse thereof and is free of said associated slot of said three slots in said body of said blade assembly when said blade assembly is in said retracted mode and extends radially outwardly when said blade assembly is in said extended mode.

10. The broadhead as defined in claim 9, wherein said base of each blade of said three blades of said blade assembly has a projection that extends perpendicularly upwardly therefrom, intermediate said leg thereof and said hypothenuse thereof.

11. The broadhead as defined in claim 10, wherein each blade of said three blades of said blade assembly further has a barb that extends outwardly from where said base thereof meets said leg thereof, and faces forwardly when said blade assembly is in said retracted mode, and is in said associated slot of said three slots in said body of said blade assembly when said blade assembly is in said extended mode.

12. The broadhead as defined in claim 11, wherein said blade assembly further comprises an elastic ring with a tension and which extends around said hypothenuse of each blade of said three blades of said blade assembly and in one annular groove of said plurality of annular grooves in said body of said blade assembly when said blade assembly is in said retracted mode, with said tension of said elastic ring and said one annular groove of said plurality of annular grooves in said body of said blade assembly chosen determining amount of force necessary for said blade assembly to achieve said expanded position, and with said blade assembly achieving said expanded position a fter said blade assembly has entered a prey and said barb of each blade of said three blades of said blade assembly contacts hard tissue causing said three blades of said blade assembly to pivot outwardly and backwardly until said base of each blade of said three blades of said blade assembly seats in said associated slot of said three slots in said body of said blade assembly and said elastic ring of said blade assembly jumps out of said one annular groove of said plurality of annular grooves in said blade assembly and becomes lodged around said base of each blade of said three blades of said blade assembly, between said projection thereof and said hypothenuse thereof, causing said blade assembly to be maintained in said expanded position.

13. The broadhead as defined in claim 12, wherein said base is noncontinuous adjacent the projection so as to allow insertion of the elastic ring there through.

14. The broadhead as defined in claim 8, wherein each blade of said three blades of said blade assembly is pivotally mounted in an associated slot of said three slots in said body of said blade assembly by a pivot pin that passes through where said base thereof meets said hypothenuse thereof.

15. The broadhead as defined in claim 1, wherein said locking apparatus comprises a disk that is coaxially and rotatably disposed on, and has same diameter as, said distal end of said body of said blade assembly.

16. The broadhead as defined in claim 15, wherein said disk of said locking apparatus has a perimeter and a throughbore that extends coaxially therethrough and communicates with said bore in said distal end of said body of said blade assembly.

17. The broadhead as defined in claim 16, wherein said disk of said locking apparatus further has three slots that extend radially inwardly from, and open into, said perimeter of said disk of said locking apparatus, and selectively align, by rotation of said disk of said locking apparatus, respectively, with said three slots in said body of said blade assembly when said blade assembly is in said retracted mode and it is wished that said blade assembly ultimately achieve said expanded mode, by allowing said three blades of said blade assembly to leave said three slots in said disk of said locking apparatus.

18. The broadhead as defined in claim 17, wherein said disk of said locking apparatus further has three throughbores that extend radially in said disk of said locking apparatus, between said three slots in said disk of said locking apparatus, and do not open into said perimeter of said disk of said locking apparatus and said throughbore in said disk of said locking apparatus.

19. The broadhead as defined in claim 18, wherein said three throughbores in said disk of said locking apparatus selectively align, by rotation of said disk of said locking apparatus, respectively, with said three slots in said body of said blade assembly when said blade assembly is in said retracted mode and it is not wished that said blade assembly ultimately achieve said expanded mode, by capturing and preventing said three blades of said blade assembly from leaving said three slots in said disk of said locking apparatus.

20. The broadhead as defined in claim 18, wherein said disk of said locking apparatus is prevented from further rotation once aligned, by said tab on said distal end of said body of said blade assembly engaging one slot of said three slots in said disk of said locking apparatus and one throughbore of said three throughbores in said disk of said locking apparatus.

21. The broadhead as defined in claim 16, wherein said locking apparatus further comprises a ferrule assembly that comprises a collar that is coaxially and axially movably disposed on, and has same diameter as, said disk of said locking apparatus.

22. The broadhead as defined in claim 21, wherein said ferrule assembly of said locking apparatus further comprises a post that extends coaxially from said collar of said ferrule assembly of said locking apparatus, freely through said throughbore in said disk of said locking apparatus, and axially movably into said bore in said distal end of said body of said blade assembly.

23. The broadhead as defined in claim 22, wherein said ferrule assembly of said locking apparatus further comprises a compression spring that is disposed around said post of said ferrule assembly of said locking apparatus, and biases said collar of said ferrule assembly of said locking apparatus against said disk of said locking apparatus, which causes said disk of said locking apparatus to be biased against said distal end of said body of said blade assembly, which prevents unintentional rotation of said disk of said locking apparatus.

24. The broadhead as defined in claim 23, wherein said locking apparatus further comprises a point which is disposed on said collar of said ferrule assembly of said locking apparatus for movement therewith.

25. The broadhead as defined in claim 24, wherein said point of said locking apparatus has a throughbore that extends transversely therethrough, which removably receives a rod that when pulled, causes said collar of said ferrule assembly of said locking apparatus to move axially outwardly away from said disk of said locking apparatus, against said biasing of said spring of said ferrule assembly of said locking apparatus, allowing said disk of said locking apparatus to be intentionally rotated.

26. The broadhead as defined in claim 25, wherein said bore in the distal end of the body of the blade assembly is a threaded bore.

27. The broadhead as defined in claim 26, wherein said post of said ferrule assembly of said locking apparatus is a threaded post that threadably moves in the threaded bore in the distal end of the body of the blade assembly when the rod of the locking apparatus is rotated.

* * * * *